US007100493B2

(12) United States Patent
Nomura

(10) Patent No.: US 7,100,493 B2
(45) Date of Patent: Sep. 5, 2006

(54) PNEUMATIC ACTUATOR

(75) Inventor: Yasuyuki Nomura, Nagano (JP)

(73) Assignee: Kitz Corporation, Chiba (JP)

( * ) Notice: Subject to any disclaimer, the term of this patent is extended or adjusted under 35 U.S.C. 154(b) by 71 days.

(21) Appl. No.: 10/511,298

(22) PCT Filed: Jun. 13, 2003

(86) PCT No.: PCT/JP03/07547

§ 371 (c)(1),
(2), (4) Date: Oct. 15, 2004

(87) PCT Pub. No.: WO03/106846

PCT Pub. Date: Dec. 24, 2003

(65) Prior Publication Data

US 2005/0166752 A1 Aug. 4, 2005

(30) Foreign Application Priority Data

Jun. 14, 2002 (JP) ..... 2002-175000

(51) Int. Cl.
*F01B 31/12* (2006.01)
*F01B 9/00* (2006.01)

(52) U.S. Cl. ..... 92/136; 92/5 R; 92/130 R

(58) Field of Classification Search ..... 92/5 R, 92/86.5, 130 R, 136
See application file for complete search history.

(56) References Cited

U.S. PATENT DOCUMENTS

| | | | | | |
|---|---|---|---|---|---|
| 1,834,607 | A | * | 12/1931 | Dove | 92/136 |
| 4,281,588 | A | * | 8/1981 | Jaske | 92/136 |
| 4,457,210 | A | * | 7/1984 | Pauliukonis | 92/136 |
| 4,882,977 | A | * | 11/1989 | Himeno et al. | 92/5 R |
| 4,903,529 | A | | 2/1990 | Hodge | |
| 5,014,598 | A | * | 5/1991 | Champagne | 92/136 |
| 5,207,111 | A | * | 5/1993 | Trenner | 92/136 |
| 5,427,012 | A | * | 6/1995 | Frigon et al. | 92/136 |
| 6,776,083 | B1 | * | 8/2004 | Helasuo et al. | 92/136 |

FOREIGN PATENT DOCUMENTS

| | | |
|---|---|---|
| DE | 2 237 244 | 2/1974 |
| JP | 56-044819 | 4/1981 |
| JP | 11-230118 | 8/1999 |

* cited by examiner

*Primary Examiner*—Edward K. Look
*Assistant Examiner*—Michael Leslie
(74) *Attorney, Agent, or Firm*—Wenderoth, Lind & Ponack, L.L.P.

(57) ABSTRACT

A pneumatic actuator includes a cylinder, an output shaft disposed rotatably in the cylinder, a pinion disposed in the output shaft, a piston rod furnished with rack teeth to be meshed with the pinion, and pistons disposed one each at opposite ends of the piston rod, wherein the pneumatic actuator further includes a pressure-inspecting chamber enclosed with the cylinder and the piston and a pressure-detecting hole establishing communication between the pressure inspecting chamber and the exterior.

5 Claims, 8 Drawing Sheets

PNEUMATIC ACTUATOR

BACKGROUND OF THE INVENTION

1. Technical Field

This invention relates to a pneumatic actuator for rotating an output shaft by transforming a linear motion (reciprocating motion) generated by compressed air into a rotary motion. More particularly, this invention relates to a pneumatic actuator to be applied to a ball valve, a butterfly valve or other similar valve that switches a valve body, such as a ball or a disk, by a rotation of about 90°.

2. Description of the Related Art

The conventional pneumatic actuator for use in the valve has adopted such a structure as to impart a switching motion to the valve body of a rotary valve, such as a ball valve or a butterfly valve, by converting a linear motion (reciprocating motion) into a rotary motion through a built-in motion-transforming mechanism and causing the turning force produced in an output shaft in consequence of the transformation effected by the aforementioned motion-transforming mechanism to a stem connected to the output shaft. The motion-transforming mechanism that is built in this actuator is known in the scotch yoke type and the rack-and-pinion type. Particularly, most actuators of small sizes adopt the rack-and-pinion type motion-transforming mechanisms.

Incidentally, the rack-and-pinion type motion-transforming mechanisms generally have a structure comprising a rotatably disposed output shaft furnished in a cylinder with a pinion, a pair of pistons disposed in the cylinder and adapted to produce a reciprocating motion therein, and racks fitted each to the pistons so that the reciprocating motion of the pistons may be transformed into a rotary motion by virtue of the mesh to be formed between the racks and the pinion.

In the rack-and-pinion type pneumatic actuators mentioned above, the inclinations of the pistons during the operation thereof are ordinarily regulated on the basis of the effective diameters of the pinions and the racks of the pistons by the sliding surfaces occurring between the outside diameters of the pistons and the inside diameter of the cylinder and particularly the pistons themselves during their reciprocating motions tend to produce a phenomenon of inclining in the axial or rotary direction thereof. These actuators, therefore, have entailed the problem of suffering the pistons to sustain fracture and scouring their surfaces even to an extent of degrading their output efficiency.

The following techniques have been heretofore proposed as measures to cope with these problems. JP-A-SHO 53-103915 (hereinafter referred to as "Patent Document 1") discloses a structure which, with the object of coping with the problem, precludes the phenomenon of the inclination of the pistons during the reciprocating motion thereof by having pistons provided one each at the opposite terminals of a piston rod furnished with rack teeth to be meshed with a pinion and causing an annular body fixed with a key to the shaft to be brought into rolling contact with a travel route fastened to the supporting parts of the rack teeth.

Utility Model Registration No. 2561362 (hereinafter referred to as "Patent Document 2") teaches an actuator that is provided along the longitudinal direction of a rack surface with a guide rail and has this guide rail disposed so as to be freely guided on the outer peripheral surface of an output shaft.

The prior art references mentioned above concern techniques that, in actuators adapted to switch a valve with compressed air and a compression spring respectively as a power source, make it possible to alleviate the phenomenon of the inclination of the pistons used therein toward the axial directions and the rotary directions thereof. The technique disclosed in Patent Document 1 requires an annular part for contact with the rack. When the actuator is in such a structure as to induce deviation of the output shaft from the center of the cylinder, the annular body mentioned above is inevitably suffered to interfere with the inside diameter of the cylinder of the actuator and, to avoid this trouble, is required to be replaced with a contacting member of a special shape.

Then, the technique disclosed in Patent Document 2 requires the guide rail for supporting the rack to be fixed to the actuator body. Thus, this technique results in adding to the number of component parts and complicating the structure of the actuator.

Further, in the case of a high-output actuator of the spring return type, though the compression spring thereof is fated to assume a large size and generate a large resilient repulsive force, this compression spring is formed in a helical shape and the terminal part of this compression spring is consequently enabled to generate in increasing prominence a retracting action in the circumferential direction of the spring diameter in consequence of the expansion and contraction of the spring. Moreover, since the terminal part of the compression spring is pressed against the piston, the retracting action of the terminal part of the compression spring has the possibility of rotating the piston and causing the rack disposed integrally on the piston to tilt and unevenly collide against the pinion disposed integrally on the output shaft and consequently curtailing the service life of the actuator.

Patent Document 2 discloses a concept of providing a blocking plate disposed integrally on the terminal part of a cylinder containing a compression spring with an air vent that is adapted to admit air into the cylinder and discharge air from the cylinder.

This air vent indeed is disposed at such a position as to avoid the terminal part of the compression spring. The air vent has the possibility of being blocked by the terminal part of the compression spring when the actuator is miniaturized. The air vent also has the possibility of leaking rainwater therethrough when the actuator is used outdoors.

This invention has been developed in light of the various problems encountered by the prior art. It is aimed at providing a pneumatic actuator which is capable of preventing a piston from developing a phenomenon of inclining in the axial or rotary direction, enabling the reciprocating motion of the piston to be stably maintained for a long time, facilitating an inspection for confirming the property of sealing the cylinder and the piston and allowing the inspection to be infallibly performed quickly as well, and enabling the inspection of the operation and the inspection for detection of outer leakage to be simultaneously carried out.

It is further aimed at providing a pneumatic actuator which even in a combined operation type structure avoids suffering a compression spring to pop out during an overhaul, allows the aperture of the actuator to be adjusted as well on the compression spring-containing side, permits the interior of a cylinder containing the compression spring to be provided with an air vent incapable of leaking rainwater, and forms only a few parts projecting from the external shape of the actuator.

SUMMARY OF THE INVENTION

To attain the above objects, the present invention provides a pneumatic actuator comprising a cylinder, an output shaft disposed rotatably in the cylinder, a pinion disposed in the output shaft, a piston rod furnished with rack teeth to be meshed with the pinion, and pistons disposed one each at opposite ends of the piston rod. The pneumatic actuator further comprises a pressure-inspecting chamber enclosed with the cylinder and the piston and a pressure-detecting hole establishing communication between the pressure inspecting chamber and an exterior. In the pneumatic actuator, the pressure-inspecting chamber or the pressure-detecting hole can be provided therein with a pressure sensor for detecting an inner pressure of said pressure-inspecting chamber.

Another aspect of the invention provides a pneumatic actuator comprising a cylinder, an output shaft disposed rotatably in the cylinder, a pinion disposed in the output shaft, a piston rod furnished with rack teeth to be meshed with the pinion, and pistons disposed one each at opposite ends of the piston rod. The pneumatic actuator satisfies $0.2D<e<0.35D$, in which D stands for an inside diameter of the cylinder and e stands for a distance between a center line of the piston and a center line of the pinion, to establish conformity between the center line of the piston and a pitch line of the rack teeth.

Another aspect of the invention provides a pneumatic actuator comprising a cylinder, an output shaft disposed rotatably in the cylinder, a pinion disposed in the output shaft, a piston rod furnished with rack teeth to be meshed with the pinion, and pistons disposed one each at opposite ends of the piston rod, wherein the pneumatic actuator further comprises ribs disposed one each above and below the rack teeth of the piston rod and has end parts of the ribs caused to collide against an outer periphery of the output shaft. In the pneumatic actuator, the rib above the rack teeth can be furnished with an opening part for allowing visual inspection of the rack teeth.

Another aspect of the invention provides a single operation pneumatic actuator possessing a spring and comprising a cylinder, an output shaft disposed rotatably in the cylinder, a pinion disposed in the output shaft, a piston rod furnished with rack teeth to be meshed with the pinion, and pistons disposed one each at opposite ends of the piston rod. The pneumatic actuator further comprises a spring retainer for compressing the spring, which spring retainer is provided with a retainer guide that freely guides the spring retainer, and a stopper bolt inserted into the retaining guide. In the single operation pneumatic actuator, the retainer guide is formed in a cylindrical shape.

Another aspect of the invention provides a single operation pneumatic actuator possessing a spring and comprising a cylinder, an output shaft disposed rotatably in the cylinder, a pinion disposed in the output shaft, a piston rod furnished with rack teeth to be meshed with the pinion, and pistons disposed one each at opposite ends of the piston rod. The pneumatic actuator further comprises a cylindrical spring case for containing the spring, which case is provided on an outer peripheral face thereof with an air vent. In the single operation pneumatic actuator, the cylindrical spring case can be provided with a flange part lateral face on which projected is a blocking part for blocking an end part of a communicating hole establishing communication between a pressure feeding and releasing port and a pressure feeding and releasing chamber of a main body of the actuator, and the communicating hole is juxtaposed to the blocking part. In the single operation pneumatic actuator, the air vent can have attached thereto an elbow furnished in a lower direction of the actuator with an opening part.

According to this invention, the reciprocating motion of the piston can be maintained stably for a long time because the rack teeth and the pinion can be meshed while the center line of the piston and the pitch line of the rack teeth are kept in conformity with each other.

Further, the cylinder is provided in the interior thereof with a pressure-checking chamber. By detecting the internal pressure of this pressure-checking chamber via a pressure-detecting hole during the course of a test, it is made possible to simplify the test for confirming the property of sealing a cylinder and a piston, a work which has hitherto consumed much time and labor, enable this test to be effected infallibly in a short time, permit as well the test for operation and the test for external leak to be simultaneously performed, and relieve the burden on an operative engaging in the test.

Further, owing to the provision of a pressure sensor, it is made possible to detect abnormality in the property of sealing the cylinder and the piston and inform this detection to a remote site.

Even during the course of the automatic operation, the test for the property of sealing the cylinder and the piston can be carried out.

In yet another aspect of this invention, the piston rod provided with rack teeth is prevented from being guided and rotated by the output shaft or the cylindrical thrust bearing fitted on the outer periphery of the output shaft and is enabled to preclude the phenomenon of bias collision of the piston rod and the pinion and stabilize further the reciprocating motion of the piston. During the incorporation of the product, the engagement of the rack teeth and the pinion can be easily confirmed visually and can be accomplished infallibly and the operation of assembly can be easily and infallibly carried out.

Even in the case of a pneumatic actuator of the single operation type, the reciprocating motion of the piston can be stabilized similarly to the pneumatic actuator of the duplex operation type and the cylinder of the duplex operation type can be directly utilized in its unmodified form. When a cylindrical retainer guide is used, the operation can be stabilized and the assembly can be facilitated. Further, this actuator can be used as a high-output actuator.

Further, owing to the fact that an air hole is provided in the outer peripheral surface of a spring case, this air hole has no possibility of being occluded and is further prevented from invasion of rainwater and enabled to maintain its air permeability. By causing a blocking part for blocking the terminal part of a communicating hole to protrude and a ventilating elbow to adjoin the blocking part, it is made possible to protect the elbow against damage.

This pneumatic actuator is enabled to have the weight thereof greatly decreased by having the cylinder, piston, piston rod, etc. thereof made by die-casting using aluminum.

DETAILED DESCRIPTION OF THE INVENTION

For more specific description of this invention, the invention will be described below with reference to the accompanying drawings.

Figure 1:
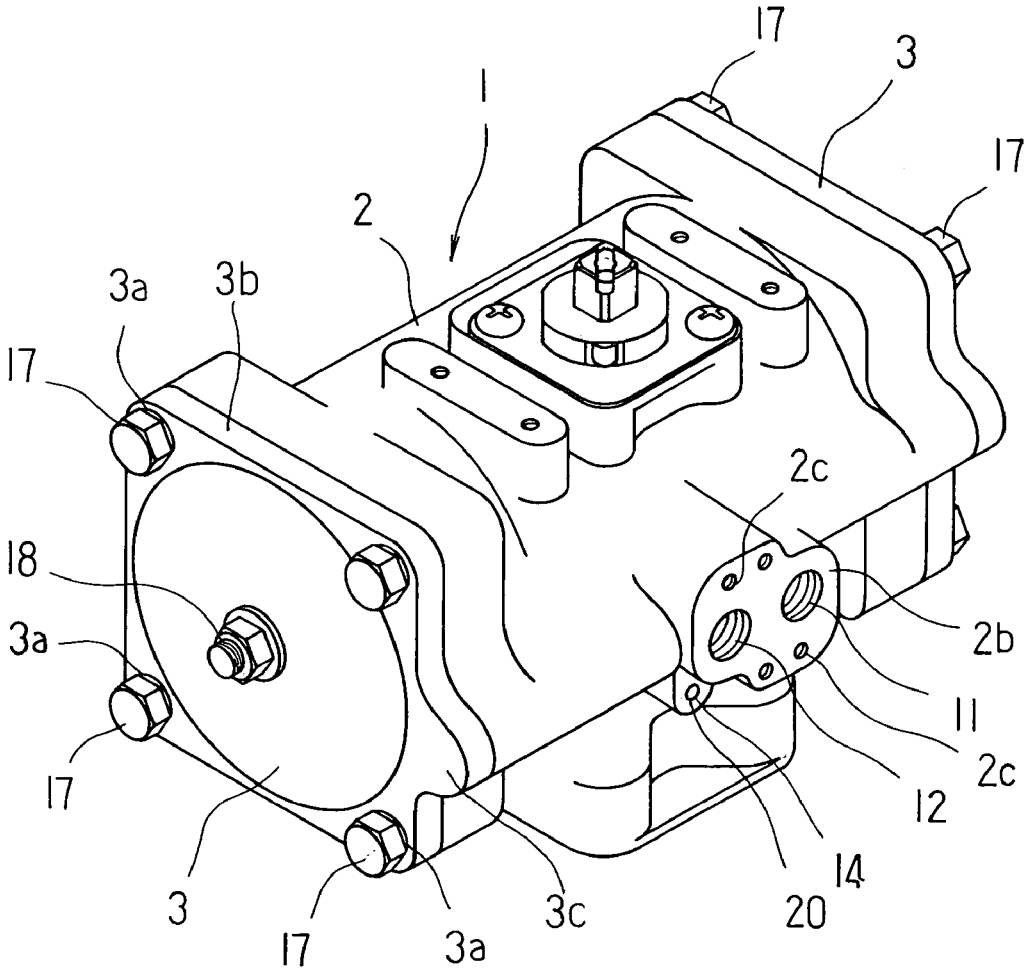
FIG. 1 is a perspective view illustrating one embodiment of the pneumatic actuator contemplated by this invention.
Figure 2:
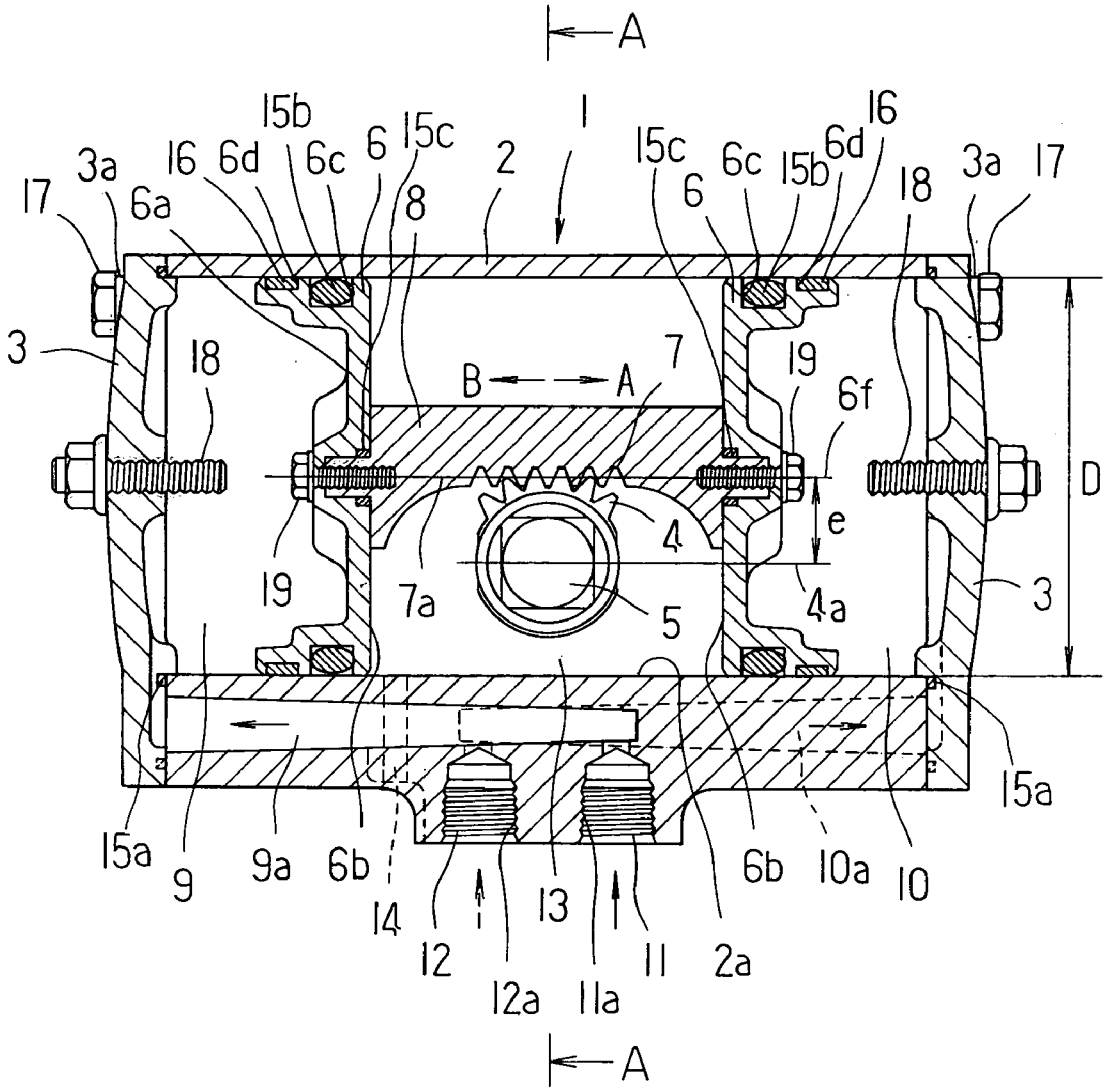
FIG. 2 is a cross section of FIG. 1.

One embodiment of this invention is illustrated in FIG. 1 and FIG. 2. A pneumatic actuator 1 in this invention is produced by die-casting using aluminum. It is formed of a cylinder 2 as a single part, end covers 3, 3 stoppering the opposite ends of the cylinder 2 while sealing them with O rings 15*a* and 15*a*, an output shaft 5 provided integrally or separately with a pinion 4, a pair of pistons 6 and 6 made by die-casting using aluminum and opposed to each other across the output shaft 5, a piston rod 8 made by die-casting using aluminum and having formed therein rack teeth 7 adapted to be meshed with the pinion 4, pressure feeding and releasing chambers 9 and 10 utilizing the outside lateral faces 6*a* of the piston 6 as inner walls, pressure feeding and releasing ports 11 and 12 communicating with the pressure feeding and releasing chambers 9 and 10 through the communicating holes 9*a* and 10*a*, a pressure-checking chamber 13 enclosed with the inner peripheral face 2*a* of the cylinder 2 and the inside lateral faces 6*b* and 6*b* of the pair of pistons 6 and 6, and a pressure-checking hole 14 for establishing communication between the pressure-checking chamber 13 and the exterior.

The paired pistons 6 and 6 have inserting grooves 6*c* and 6*d* formed therein and allow an O-ring 15*b* to be inserted in the inserting groove 6*c* and a piston bearing 16 to be inserted in the inserting groove 6*d* so as to slide on the inner peripheral face 2*a* of the cylinder 2.

The paired pistons 6 and 6 are disposed as opposed to each other across the output shaft 5 that is rotatably disposed inside the cylinder 2. These pistons are disposed integrally or separately with the opposite ends of the piston rod 8.

In the present embodiment, since the piston 6 is fixed with a bolt 19 to the piston rod 8 through an O-ring 15*c* and the plane of this fixation forms vertical symmetry centering around the axis of the bolt 19 in the bearings of FIG. 2, the piston 6 is not exposed to a bias load and the phenomenon of inclination of the piston 6 during the course of sliding motion can be precluded.

The piston rod 8 has rack teeth 7 formed therein and the rack teeth 7 are meshed with the pinion 4 that is disposed integrally or separately with the output shaft 6.

In this case, by satisfying the condition of $0.2D<e<0.35D$, wherein D stands for the inside diameter of the cylinder 2 and e for the distance between the center line 6*f* of the piston 6 and the center line 4*a* of the pinion 4, the rack teeth 7 and the pinion 4 are enabled to be meshed with each other while the center line 6*f* of the piston 6 and the pitch line 7*a* of the rack teeth 7 are maintained in alignment.

Figure 6:
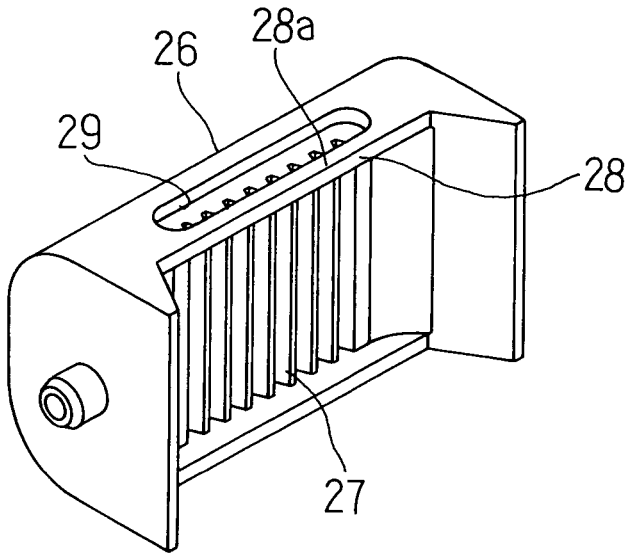
FIG. 6 is a perspective view of a piston rod in another aspect of this invention.
Figure 7:
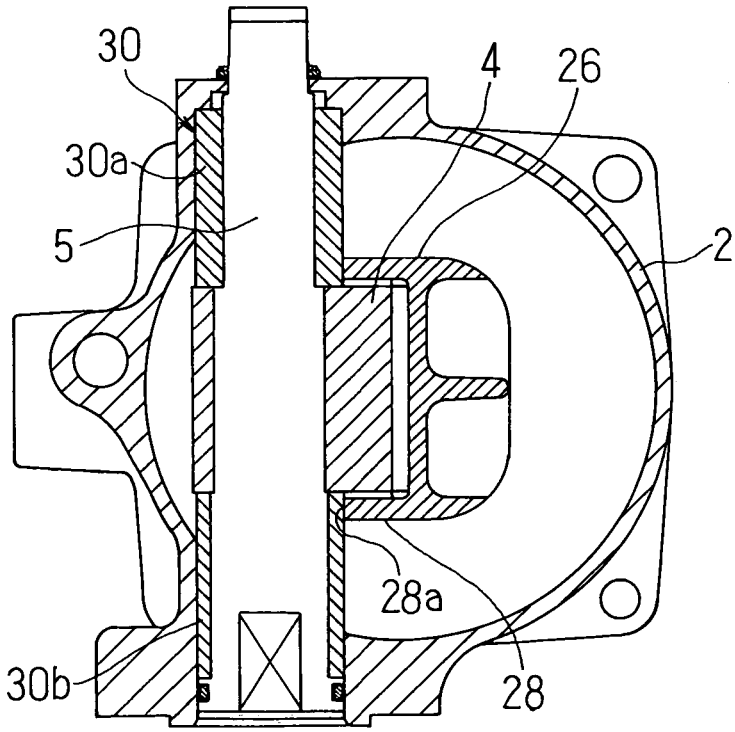
FIG. 7 is a cross section taken through FIG. 2 along line A—A.

When the output of the actuator is large and the motion of the piston 6 or the retracting action of a spring is conspicuous, a piston rod 26 formed by extending a plate rib 28 is disposed in the longitudinal direction of the vertical line of the rack as contemplated in still another aspect of this invention illustrated in FIG. 6. In this piston rod 26, the upper rib 28 is provided with an opening part 29 that enables the engagement between rack teeth 27 and the pinion to be confirmed visually during the course of the assemblage of the actuator.

The piston rod 26 is produced by die-casting using aluminum so as to permit easy formation of the rib 28 and the opening part 29 mentioned above.

Figure 3:
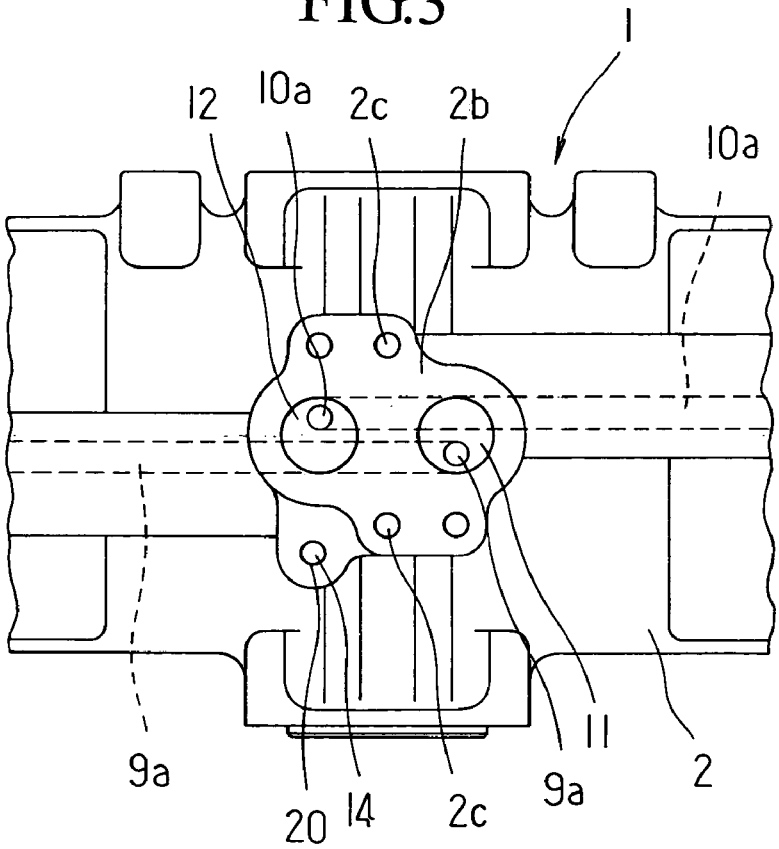
FIG. 3 is a front view illustrating the positional relation between a pressure inlet/outlet and a pressure-detecting hole (pressure-detecting port).
Figure 4:
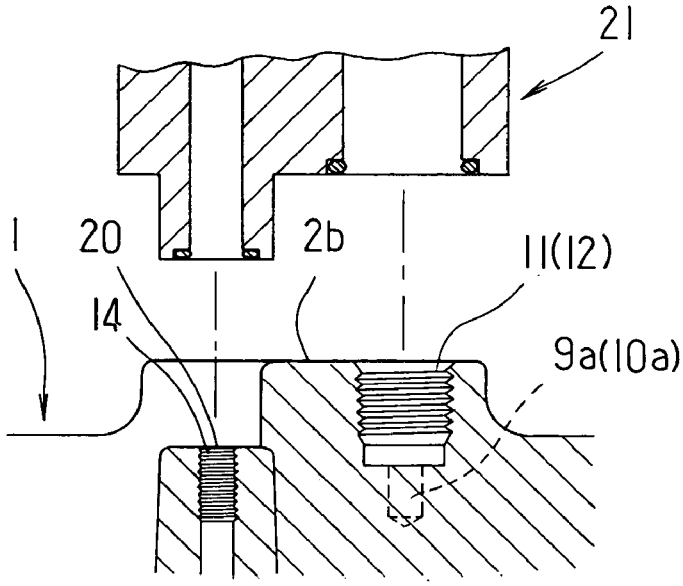
FIG. 4 is a partially cutaway cross-section of the port region of a pneumatic actuator and the port region of a checking jig in this invention.

The pressure feeding and releasing chambers 9 and 10 are disposed as enclosed with the inner peripheral face 2*a* of the cylinder 2, the outside lateral faces 6*a* of the piston 6 and the end covers 3. The pressure feeding and releasing chambers 9 and 10 are made to communicate with the pressure feeding and releasing ports 11 and 12 through the communicating holes 9*a* and 10*a* disposed vertically in parallel as illustrated in FIG. 3. Screw parts 11*a* and 12*a* are formed on the inner faces of the pressure feeding and releasing ports 11 and 12.

The end covers 3 have the regions thereof that border the bolt holes each formed in the shape of a seating face 3*a*. They are mounted and fixed with a hexagonal bolt 17 to the cylinder 2 through the seating faces 3*a*. The end covers 3 are each provided at the center thereof with a stopper bolt 18. The stopper bolts 18 are intended to effect fine adjustment of the apertures of the working ends by colliding against the fixing bolt 19 serving to fix the piston 6 and the piston rod 8.

Further, in the present embodiment, an output port (not shown) of an electromagnetic valve is directly fitted to the pressure feeding and releasing ports 11 and 12 through O-rings (not shown in the diagram) and screwed with a mounting screw (not shown) to a screw part 2*c* formed in a projected part (port part) 2*b* of the cylinder 2 so as to fix the electromagnetic valve (not shown) directly to the cylinder 2.

Inside the cylinder 2, the pressure-inspecting chamber 13 is disposed as enclosed with the inner peripheral face 2*a* of the cylinder 2 and the inside lateral faces 6*b* and 6*b* of the paired pistons 6 and 6. The pressure-inspecting chamber 13 communicates with a pressure-inspecting port 20 through the pressure-detecting hole 14. The pressure-inspecting port 20 is disposed at a position below the projected part 2*b* as illustrated in FIG. 3 so as to avoid interfering with the electromagnetic valve (not shown) that is directly mounted to the projected part 2*b* of the cylinder 2.

A pressure sensor (not shown) is mounted on the pressure-detecting hole 14 to effect constant management of the inner pressure of the cylinder 2 and, on detecting a leak of pressure, emit a signal informing the abnormality.

Now, the operation of the present example will be described below.

By feeding compressed air through the pressure feeding and releasing port 11 into the pressure feeding and releasing chamber 9 via the communicating hole 9*a* as indicated by the arrow marks of solid line in FIG. 2, the piston 6 and the piston rod 8 are caused to slide in the direction of arrow "A" and consequently induce the air in the pressure feeding and releasing chamber 20 to be discharged via the pressure feeding and releasing port 12.

Since the pinion 4 that is meshed with the rack teeth 7 formed on the piston rod 8 is rotated clockwise in consequence of this movement, the valve body (not shown), such as that of a ball valve, connected to the output shaft 5 is rotated by about 90° to make a switching motion of the valve body.

Subsequently, by switching the ensuing state to the evacuation of the interior of the pressure feeding and releasing chamber 9 and, at the same time, supplying air from the pressure feeding and releasing port 12 via the communicating hole 10*a* into the pressure feeding and releasing chamber 10 as indicated by the arrow marks of chain line, the piston 6 and the piston rod 8 are caused to slide in the direction of arrow "B" and consequently induce the air in the pressure feeding and releasing chamber 9 to be discharged via the pressure feeding and releasing port 11.

Since the pinion 4 that is meshed with the rack teeth 7 formed on the piston rod 8 is rotated counterclockwise in consequence of this movement, the valve body (not shown), such as that of a ball valve, connected to the output shaft 5 is rotated by about 90° to make a switching motion of the valve body.

In this case, satisfied is the condition, $0.2D<e<0.35D$, wherein D stands for the inside diameter of the cylinder 2 and e stands for the distance between the center line 6*f* of the piston 6 and the center line 4*a* of the pinion 4.

This limitation, $0.2D<e<0.35D$, is observed for the following reason.

It has been found that if the distance e falls short of 0.2D, the shortage will result in exerting an influence on the transmission of the driving force of the pneumatic actuator 1 as by giving an unduly small diameter to the output shaft 5 which is inserted into the pinion 4 or rendering it difficult to secure such a number of teeth for the rack teeth 7 as is necessary for the rotation of the output shaft by about 90°.

It has been found that if the distance e conversely exceeds 0.35D, the excess will result in influencing the size of the pneumatic actuator 1 and the number of component parts thereof as by suffering the piston rod 8 in the process of being incorporated into the cylinder 2 to interfere with the inner wall of the cylinder 2 or with the pinion 4 integrated with the output shaft 5 inserted in the cylinder 2 and, for the sake of avoiding this interference, requiring to increase the diameter of the cylinder 2 and secure a large space solely for the region for disposing the pinion 4 as a separate part.

Thus, by limiting the magnitude of e in the range mentioned above, thereby enabling the rack teeth 7 to be meshed with the pinion 4 while retaining the center line 6*f* of the piston 6 and the pitch line 7*a* of the rack teeth 7 in alignment without enlarging the diameter of the cylinder 2 or increasing the number of component parts of the cylinder while paying due consideration to the transmission of the drive force or the ease of assembly, it is made possible to prevent the phenomenon of inclination of the piston during the course of sliding and prevent the output efficiency from being degraded.

Since the pressure feeding and releasing chambers 9 and 10 are made to communicate respectively with the pressure feeding and releasing ports 11 and 12 through the communicating holes 9*a* and 10*a* as described above, it is made possible by having the pressure feeding and releasing ports 11 and 12 vertically disposed in parallel to each other to shorten the lengths of the air-feeding paths from the pressure feeding and releasing ports 11 and 12 to the pressure feeding and releasing chambers 9 and 10.

Further, by having the regions of the end covers 3 bordering the bolt holes formed in the seating faces 3*a* integrally with the end covers 3, it is made possible to use the hexagonal bolts 17 as the fixing bolts. Since the outside diameters of the seating faces 3*a* are kept within the opposite side distances of hexagon of the bolts, the scratches inflicted to the coats of the seating faces during the helical insertion of the bolts are not exposed. Further, since the contact face pressures between the seating faces and the hexagonal bolts 17 are maintained at a high level without requiring use of a facing ring, the torques of transmission of the tightening force of the bolt is not lowered and the tightened condition is infallibly maintained.

The end covers 3 and 3 attached to the opposite ends of the cylinder 2 are identical in shape and, therefore, are usable interchangeably. The end covers on the opening side and the closing side alike may have their operating apertures regulated arbitrarily by simply replacing the stopper bolts 18.

That is, they are capable of being regulated to proper intermediate apertures.

The pressure-inspecting chamber 13 that is enclosed with the inner peripheral face 2*a* of the cylinder 2 and the inside lateral faces 6*b* and 6*b* of the pair of pistons 6 and 6 is also provided. By detecting the inner pressure of the pressure-inspecting chamber 13 through the pressure-detecting hole 14 during the course of an inspection, therefore, it is made possible to inspect simultaneously the sealing property of the cylinder 2 and the piston 6 forming the pressure feeding and releasing chamber 9 and that of the cylinder 2 and the piston 6 forming the pressure feeding and releasing chamber 10.

Of course, the sealing property of the cylinder 2 and the piston 6 on either of the two sides may be confirmed selectively.

By having a pressure sensor (not shown) attached to the pressure-inspecting hole 14, it is made possible to effect constant management of the inner pressure of the cylinder 2 and, when leakage of pressure is detected, issue a signal informing the abnormality to a remote place.

In the present embodiment, as one actual instance of inspecting the operation of the pneumatic actuator 1 after assemblage, inspecting the sealing property of the cylinder 2 and the piston 6, and inspecting the actuator for external leakage, an inspecting jig 21 formed in a construction capable of effecting the feed of a pressure fluid (compressed air) into the cylinder 2 alternately through the pressure feeding and releasing ports 11 and 12 or simultaneously therethrough and sealing the pressure-inspecting hole 14 (pressure-inspecting port 20) as well is prepared and operated for effecting inspection for submersion in water.

The inspection of the operation of the alternate feeding of the pressure fluid (compressed air) is effected specifically by feeding the pressure fluid through the pressure feeding and releasing port 11 (or 12) via the communicating hole 9*a* (or 10*a*) to the interior of the pressure feeding and releasing chamber 9 (or 10), causing the pressure fluid to act on the piston 6, confirming that the piston 6 is normally slidable within the cylinder 2, then feeding the pressure fluid simultaneously through the pressure feeding and releasing ports 11 and 12, detecting the inner pressure of the pressure-inspecting chamber 13 through the pressure-detecting hole 14, and confirming the sealing property of the cylinder 2 and the piston 6 forming the pressure feeding and releasing chambers 9 and 10 based on the results of the detection and, at the same time, checking the joints in the cylinder 2, end covers 3, or other members to determine the presence or absence of an external leakage.

That is, the inspection of the operation, the inspection of the sealing property of the cylinder 2 and the piston 6, and the inspection for detection of an external leakage can be carried out simultaneously.

Figure 5:
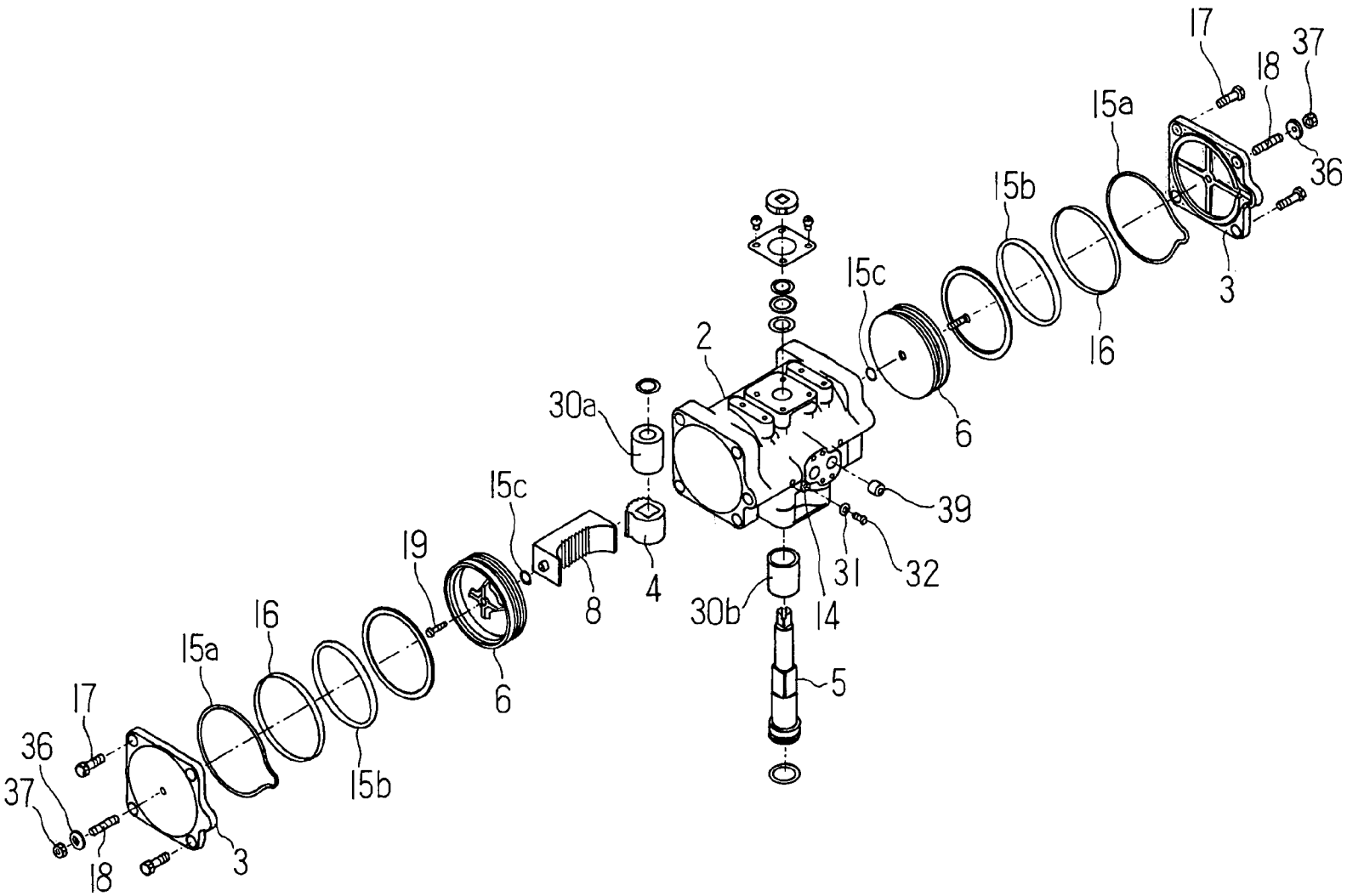
FIG. 5 is an exploded perspective view of the pneumatic actuator shown in FIG. 1.

During the use of the actuator, the pressure-inspecting hole 14 is closed with a bolt 32 through a seal washer 31 as illustrated in FIG. 5 so as to create a closed space in the pressure-inspecting chamber 13. When the actuator is to be disassembled, by first loosening this bolt 32, it is made possible to relieve the pressure-inspecting chamber 13 of the pressure even when the pressure is sealed therein. Thereafter, the work of disassembling the actuator can be carried out safely with the pressure-inspecting chamber in the state of atmospheric pressure.

When the inspection of pressure is to be effected constantly, a pressure sensor (not shown) is attached to the pressure-inspecting hole 14 and used for constantly managing the inner pressure of the cylinder 2. When the sensor detects a leak of pressure, it emits a signal indicative of the abnormality so as to permit the management to be effected at a remote place.

When the piston rod 26 resulting from extending the plate rib 28 is used, the end face 28*a* of the rib 28 is allowed to collide against the outer periphery of the output shaft and more preferably against the outer periphery of a thrust bearing 30 (made of a metallic material in the present embodiment) which is formed of cylindrical upper thrust bearing 30*a*, lower thrust bearing 30*b* mounted between the outer periphery of the output shaft 5 and the cylinder 2. This thrust bearing 30 is interposed between the output shaft 5 and the cylinder 2 with a view to smoothing the rotation of the output shaft 5 and has a long cylindrical shape in the axial direction. Due to this fact coupled with the fact that the actuator of this invention maintains the center line of the piston and the pitch line of the rack teeth 27 in alignment, the guide part of the piston rod 26 is prevented from contacting the inside diameter of the cylinder 2 even in the construction having the output shaft 5 deviate from the center of the cylinder 2 and the piston rod 26 is guided by the cylindrical thrust bearing 30 and prevented from producing rotation of itself, with the result that the phenomenon of uneven contact of the rack and the pinion mechanism will be infallibly prevented. By having the ribs 28 disposed one each above and below the piston rod 26 even in the single motion type pneumatic actuator, which will be specifically described herein below, it is made possible to prevent the piston rod from being rotated in consequence of the compression of the spring without requiring use of a separate piston rod, no matter whether the spring unit is disposed on either of the opposite lateral sides of the cylinder 2.

Figure 8:
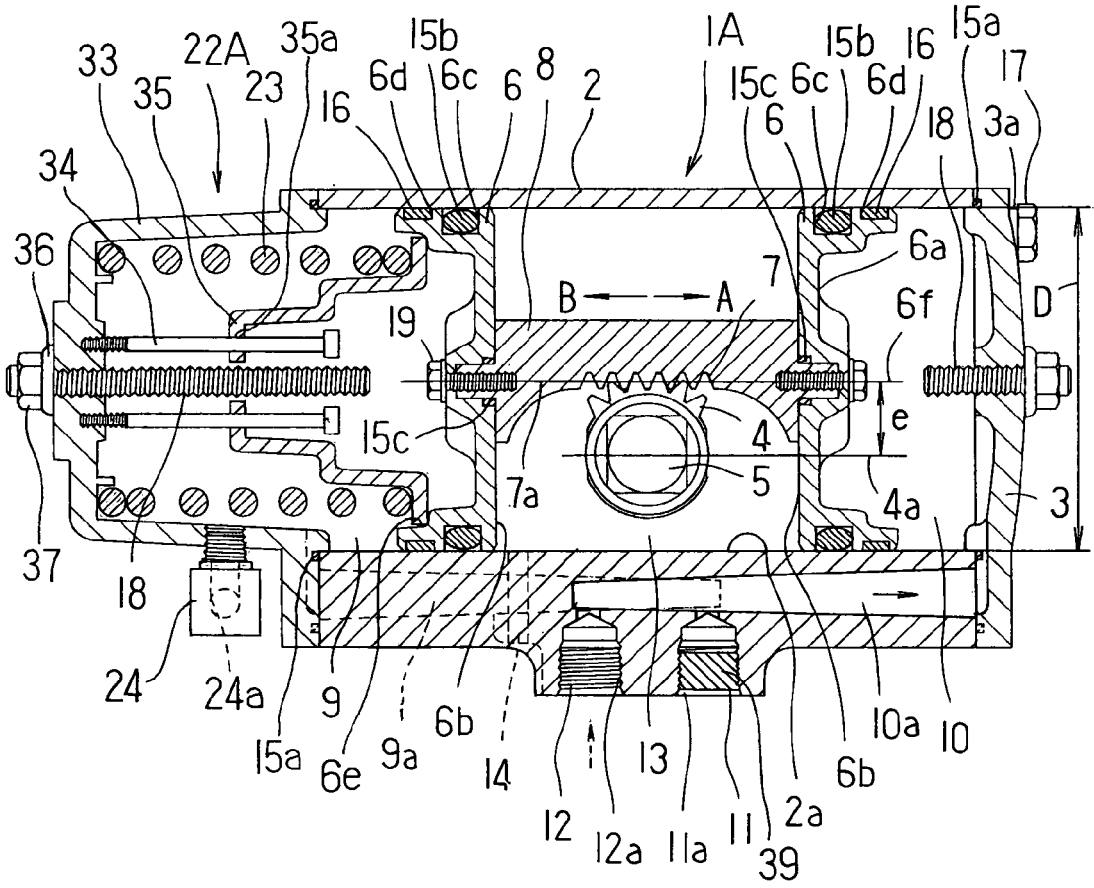
FIG. 8 is a cross section illustrating another embodiment of the pneumatic actuator in still another aspect of this invention.
Figure 9:
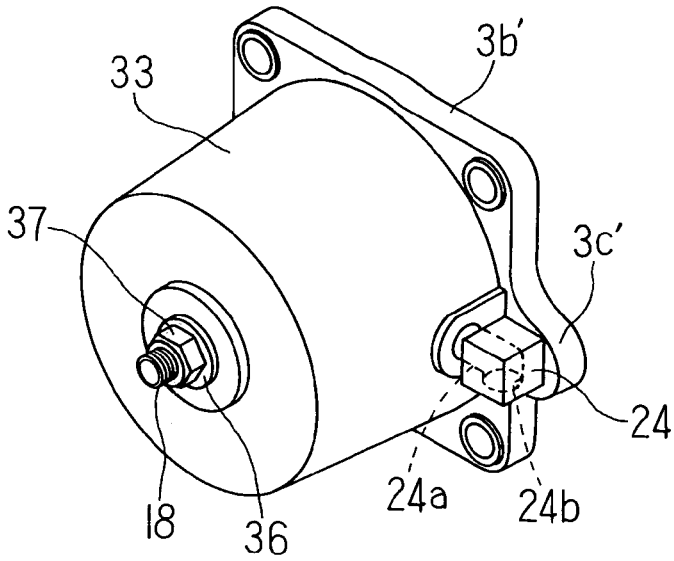
FIG. 9 is a perspective view of a spring case shown in FIG. 8.

Still another embodiment of the pneumatic actuator contemplated by this invention is illustrated in FIG. 8. As shown therein, it may be a single operation type pneumatic actuator 1A that is furnished with a spring 23. It can be easily transformed from the combined operation type pneumatic actuator by removing either of the end covers 3 disposed as attached to the opposite ends of the actuator 1 and having a cassette type spring unit 22A disposed as attached to the residual open end.

In the single operation type pneumatic actuator 1A, by feeding air through the pressure feeding and releasing port 12 into the pressure feeding and releasing chamber 10 through the communicating hole 10*a*, the piston 6 and the piston rod 8 are caused to slide in the direction of arrow "B" and, in consequence of this slide, the spring 23 is compressed and the air in the pressure feeding and releasing chamber 9 is discharged via the pressure feeding and releasing port 11.

For the purpose of rotating counterclockwise the pinion 4 meshed with the rack teeth 7 formed on the piston rod 8 in consequence of the movement mentioned above, a valve body (not shown), such as that of a ball valve, connected to the output shaft 5 is rotated by about 90° to impart a switching motion to the valve body.

When the air filling the pressure feeding and releasing chamber 10 is discharged to the exterior through an electromagnetic valve (not shown), the piston 6 and the piston rod 8 are pushed back in the direction of arrow "A" by the counterforce of the spring 23 in the compressed state and the pinion 4 is rotated clockwise. Consequently, a valve body (not shown), such as that of a ball valve, connected to the output shaft 5 is rotated by about 90° and the valve body is induced to produce a switching motion.

At this time, since the rack teeth 7 and the pinion 4 are meshed with each other while the center line 6*f* of the piston 6 and the pitch line 7*a* of the rack teeth 7 are retained in alignment similarly to the combined operation type pneumatic actuator 1, it is made possible to prevent the phenomenon of inclination of the piston 6 during the course of sliding and prevent the degradation of the output efficiency.

The stopper bolt 18 for adjusting the aperture of the actuator is attached to a blind cylindrical spring case 33 for containing the spring 23 coaxially relative to the axis of the spring case 33 and, at the same time, a plurality of retainer bolts (hexagon socket head cap screws) 34 are attached thereto so as to be positioned on a circumference concentric relative to the stopper bolt 18. By the retainer bolts 34 which are retainer guides, a spring retainer is disposed so that it can be guided freely.

In the assemblage of the spring unit part 22A, the spring 23 is interposed between the inner bottom face of the blind cylindrical spring case 33 and the outer end region of the cylindrical spring retainer 35 furnished with a plurality of steps, then the spring retainer 35 is pushed till the spring 23 assumes a compressed state, and the retainer bolt 34 having the head part thereof turned toward the piston 6 side is inserted into an insertion hole 35*a* disposed in the inner end part of the spring retainer 35 and is fixed on the inner face of the bottom part of the spring case 33 to give rise to the spring unit part 22A. The spring 23 will never pop out because this spring 23 is retained in a slightly compressed state inside the spring unit part 22A.

When the spring unit part 22A is fixed to the cylinder 2, the outer end part of the spring retainer 35 collides against a stepped part 6*e* which is formed in the inside diameter of the outside peripheral part of the piston 6. The spring 23 assumes a further slightly compressed state.

The stopper bolt 18 which is disposed inside the group of a plurality of retainer bolts 34 which are destined to serve as retaining members for the spring retainer 36 is intended for adjusting the aperture of the actuator. By causing the end part of the stopper bolt 18 disposed in the cylinder 2 to protrude more into the cylinder 2 than the head part of the retainer bolt 34 and collide against the piston 6, it is made possible to attain adjustment of the aperture of the actuator without inducing the retail bolt to interfere with the adjustment. This stopper bolt 18, after having the position thereof adjusted to form a prescribed aperture, is fixed with a nut 37 to the spring case 33 through the seal washer 36.

Thus, the spring 23 is prevented from popping out by the spring unit part 22A while the actuator is allowed to attain adjustment of aperture by the stopper bolt 18.

A ventilating elbow, which is denoted by reference numeral 24, is furnished in the interior thereof with a flow path 24*a* having the approximate shape of the letter L and is attached as disposed to adjoin a blocking part 3*c*' projected on the outer peripheral face of the cylindrical part of the blind cylindrical spring case 33 and on the lateral face of a flange part 3*b*' as well and adapted to block the end parts of the communicating holes 9*a* and 10*a* establishing communication between the pressure feeding and releasing ports 11 and 12 and the pressure feeding and releasing chambers 9 and 10 of the actuator 1A. Consequently, the air vent blocking part 3*c*' is enabled to fulfill the function of preventing infliction of a scratch on the ventilating elbow 24 destined to be formed as projected from the outer periphery of the spring case 33 besides possessing the function of blocking the end parts of the communicating hole 9*a* (10*a*). This protective function is rendered more infallible by keeping the cross section in the vertical direction of the ventilating elbow within the area of the air vent blocking part 3*c*'.

By disposing on the outer peripheral face of the cylindrical part of the blind cylindrical spring case 33 the air vent which introduces the air into the cylinder 2 and releases the air to the exterior from the cylinder 2 in consequence of the expansion and contraction of the spring 23 as described above, it is made possible to eliminate the possibility of the air vent part being blocked with the spring 23 even when the actuator is miniaturized.

Since an opening part 24*b* of this ventilating elbow 24 opens in the lower part of the actuator 1A, the opening part has no possibility of suffering from invasion of rainwater even when the actuator 1A is used outdoors.

In the case of the combined operation type pneumatic actuator, the air pressure is fed to the actuator via a four-way or five-way electromagnetic valve. This electromagnetic valve is furnished with one air pressure feeding port directed toward the electromagnetic valve, two air pressure-feeding ports directed toward the actuator, and one or two air exhaust ports directed away from the electromagnetic valve.

In the case of the single operation type actuator as in the present embodiment, the electromagnetic valve is only required to be furnished with one air pressure-feeding port directed toward the electromagnetic valve, one air pressure-feeding port directed toward the actuator, and one air exhaust port directed away from the electromagnetic valve. In this case, therefore, it is necessary either to interpose between the single operation type actuator and the electromagnetic valve an adapter for blocking one air pressure-feeding port directed toward the actuator or to prepare a separate three-way electromagnetic valve.

In this embodiment, by blocking with a plug 39, the pressure feeding and releasing port 11 that is destined to form the air vent directed toward the spring case 33 as illustrated in FIG. 8, it is made possible for the single operation type and the combined operation type to share a four-way or five-way electromagnetic valve without requiring provision of an adapter between the actuator and the electromagnetic valve or preparation of a separate three-way electromagnetic valve.

Figure 10:
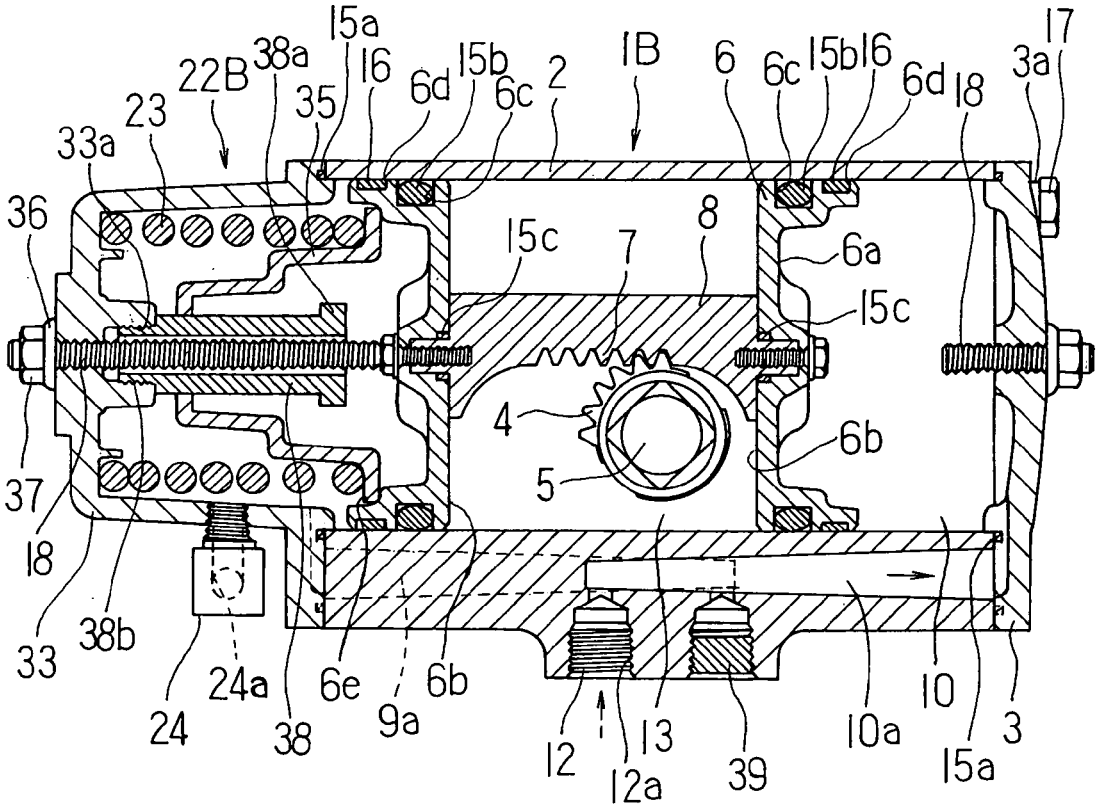
FIG. 10 is a cross section illustrating another embodiment of the pneumatic actuator in yet another aspect of this invention.
Figure 11:
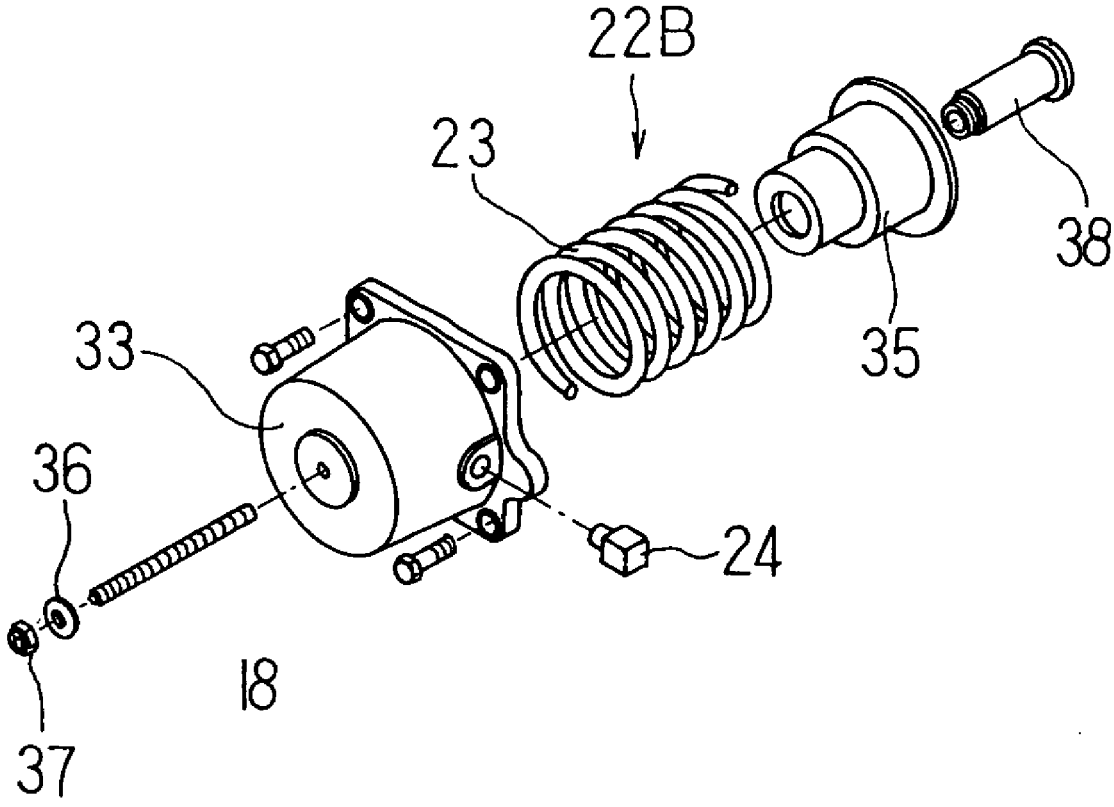
FIG. 11 is an exploded perspective view of a spring unit part shown in FIG. 10.

Another embodiment of the pneumatic actuator according to still another aspect of this invention is illustrated in FIG. 10. In this case, in the place of the retainer bolt 34 which is formed of a hexagon socket head cap screw, a bolt 38 which is destined to serve as a cylindrical shaft provided at one end thereof with a flange part 38*a* for fastening the spring retainer 35 serving to compress the spring 23 and at the other end thereof with a male screw part 38*b* to be helically fixed to the female screw 33*a* disposed in the spring case 33 is disposed as a retainer guide at the position of the axis of the spring retainer 35. This bolt 38 has a stopper bolt 18 inserted therein. Since it suffices for the assemblage of the spring unit part 22B to use the bolt 38 alone which is intended to serve as a retainer guide, the resultant structure is suitable for a high-output actuator because the structure does not transmit to the bolt 38 the rotation produced by the spring retainer 35 in consequence of the expansion and contraction of the spring 23 besides facilitating the work of assembling the spring unit part 22*b* as compared with the structure of FIG. 8 which uses a plurality of retainer bolts.

The inspections of the operation of the single operation type pneumatic actuators 1A and 1B at the time of shipment, of the sealing property of the cylinder 2 and the piston 6 and of the inspection for detection of an external leakage are carried out in the same manner as in the combined operation type pneumatic actuator 1. Thus, the description of these inspections will be omitted.

The periodic inspection is carried out in the same manner as in the combined operation type pneumatic actuator 1. Thus, the description thereof will be omitted.

Further, by providing a scotch yoke type pneumatic actuator (not shown) with the pressure-inspecting chamber 13 and the pressure-detecting hole 14 forming the pneumatic actuator 1 of this invention, it is made possible to carry out the inspection of the operation, the inspection of the sealing property of the cylinder and the piston and the inspection for detection of an external leakage in the same manner as in the present invention.

This invention can be utilized for the pneumatic actuator that rotates an output shaft by converting a linear motion (reciprocating motion) generated by compressed air into a rotary motion. It manifests the effect conspicuously when it is used for the pneumatic actuator that is applied to a ball valve, a butterfly valve and other rotary valve for switching a valve body, such as a ball or a disk, by the rotation of about 90°.

The invention claimed is:

1. A pneumatic actuator comprising a cylinder, a pair of pistons disposed slidably in the cylinder, a pressure-inspecting chamber enclosed by inside lateral faces of said pair of pistons opposed to each other and an inner peripheral face of said cylinder, an output shaft disposed in the pressure-inspecting chamber and provided with a pinion, a piston rod provided with rack teeth to be meshed with said pinion, said piston rod having opposite ends thereof connected to the inside lateral faces of the pair of pistons to transform motion of the pair of pistons into a rotary drive of the output shaft, and a pressure-detecting hole formed in the cylinder for establishing communication between said pressure-inspection chamber and an exterior, wherein the pressure-inspecting chamber or the pressure-detecting hole is provided therein with a pressure sensor for detecting an inner pressure of said pressure-inspecting chamber.

2. A pneumatic actuator according to claim 1, wherein a center line of the pair of pistons and a pitch line of said rack teeth are maintained in conformity.

3. A pneumatic actuator according to claim 1, which is a combined operation actuator provided with a pressure feeding and releasing chamber enclosed with outside lateral faces of said pair of pistons, the inner peripheral face of the cylinder and end covers disposed one each at opposite ends of said cylinder.

4. A pneumatic actuator according to claim 1, which is a single operation actuator provided with a pressure feeding and releasing chamber enclosed with an outside lateral face of one of said pair of pistons, the inner peripheral face of the cylinder and one of end covers disposed one each at opposite ends of the cylinder, and a spring attached to an outside lateral face of the other of said pair of pistons and contained in a spring case disposed in the other of the end covers.

5. A pneumatic actuator according to claim 4, wherein the spring case is provided on an outer peripheral face thereof with a communicating hole for establishing communication between an interior and an exterior of the spring case.

* * * * *